US006589342B2

(12) United States Patent
Attinoto et al.

(10) Patent No.: US 6,589,342 B2
(45) Date of Patent: Jul. 8, 2003

(54) POWDER PAINT COLOR CHANGER

(75) Inventors: Richard A. Attinoto, Orion, MI (US); Gary J. Ciarelli, Milford, MI (US); Melissa L. Koster, New Hudson, MI (US); Dragoslav K. Milojevic, Windsor (CA); Christopher M. Rennie, Waterford, MI (US)

(73) Assignee: ABB Automation Inc., New Berlin, WI (US)

( * ) Notice: Subject to any disclaimer, the term of this patent is extended or adjusted under 35 U.S.C. 154(b) by 200 days.

(21) Appl. No.: 09/824,555

(22) Filed: Apr. 2, 2001

(65) Prior Publication Data

US 2002/0139301 A1 Oct. 3, 2002

(51) Int. Cl.[7] ..... B05C 19/00

(52) U.S. Cl. ..... 118/308; 118/311; 239/113; 239/305

(58) Field of Search ..... 118/302, 308, 118/310, 311; 239/104, 106, 112, 113, 303, 304, 305, 325

(56) References Cited

U.S. PATENT DOCUMENTS

| | | | | |
|---|---|---|---|---|
| 3,777,874 A | * | 12/1973 | Birckhead | 118/308 |
| 4,248,379 A | | 2/1981 | Hollstein et al. | |
| 4,302,481 A | | 11/1981 | Ribnitz et al. | 427/27 |
| 4,380,321 A | | 4/1983 | Culbertson et al. | 239/700 |
| 4,993,353 A | | 2/1991 | Ogasawara et al. | 118/302 |
| 5,102,046 A | | 4/1992 | Diana | 239/3 |
| 5,215,261 A | | 6/1993 | Frene | 239/704 |
| 5,288,525 A | | 2/1994 | Diana | 427/475 |
| 5,743,958 A | | 4/1998 | Shutic | |
| RE35,883 E | | 9/1998 | Konieczynski | 239/3 |
| 5,813,608 A | | 9/1998 | Yoshioka et al. | 239/110 |
| 6,010,084 A | | 1/2000 | Yoshida et al. | 239/703 |
| 6,050,498 A | | 4/2000 | Minoura et al. | 239/112 |
| 6,051,280 A | | 4/2000 | Seitz et al. | 427/475 |
| 6,071,348 A | | 6/2000 | Seitz et al. | 118/712 |
| 6,080,217 A | | 6/2000 | Gobl et al. | 55/283 |
| 6,090,450 A | | 7/2000 | Kahmann et al. | 427/421 |
| 6,099,898 A | | 8/2000 | Joyce et al. | 427/195 |
| 6,112,999 A | | 9/2000 | Fingleton et al. | 239/8 |
| 6,223,997 B1 | | 5/2001 | Fulkerson et al. | |

* cited by examiner

*Primary Examiner*—Richard Crispino
*Assistant Examiner*—Yewebdar T Tadesse
(74) *Attorney, Agent, or Firm*—Harness, Dickey & Pierce, P.L.C.

(57) ABSTRACT

A powder paint color changer features a single cleaning fluid port at one end of the color changer manifold for direction of cleaning fluid, such as pressurized air, through the main output interior chamber of the color changer manifold thence through a supply hose which is adapted for coupling to a paint application device. Additionally, the powder paint color changer manifold includes a replaceable insert of impact fusion resistant material which defines the surface of the manifold's interior cavity.

16 Claims, 3 Drawing Sheets

POWDER PAINT COLOR CHANGER

BACKGROUND OF THE INVENTION

The invention relates to paint color changers for paint application systems. More particularly, the invention concerns a powder paint color changer adapted for use with paint application systems utilizing solid particulate paint particles entrained in a fluid such as air.

Paint color changers are known in the art for both liquid and powder paint applications. In liquid paint applications, the color changers are positioned as closely as possible to the paint application apparatus to save on solvent and paint waste. For powder applications, it has been found better to place the color changers closer to the source of the powder paint rather than to the application device.

In the typical powder paint application, pressurized air is used as a diluter and carrier of the powder paint particles to the application device via a color changer. Unlike the liquid paint application, powder applications do not utilize cleaning solvents. The transport air is a neutral means of transporting the powder such that the powder paint is very diluted in the hoses connecting the various apparatus of the system, and its amount is relatively small. These characteristics are what suggest placing the powder color changer closer to the feed hoppers rather than as close as possible to the paint applicator as is the case for liquid paint applications. This feature helps to reduce the number and length of powder feeding hoses in a multiple color system.

In prior art powder paint color changers, such as those disclosed in U.S. Pat. No. 4,302,481 to Ribnitz, et al., where multiple colors enter a common color changing manifold, separate air purging channels are required for each manifold powder paint input. This complicates the color changing arrangement thereby adding expense.

Another problem with powder paint applications is the phenomenon known as impact fusion. Impact fusion occurs where the particles of powder paint encounter surfaces in prior art color change manifolds having relatively high friction surfaces thereby leading to powder particle agglomeration and adhesion to the color changer surfaces. Such adhesion, in turn, leads to problems in both cleaning of the apparatus prior to changing colors and may, over time, lead to inoperativeness of the color changer due to clogging of various passageways therein.

Therefore, there is seen to be a need in the art for a color changer for powder paint applications providing facile cleaning and resistance to particulate impact fusion at powder paint carrying surfaces therein.

SUMMARY OF THE INVENTION

In accordance with the invention, a powder paint color changer has a hollow body portion having first and second opposed ports at its outer surface, the first port adapted to be coupled to a source of cleaning fluid and the second port adapted for coupling to a powder paint application device. A plurality of valves, each having an outlet in fluid communication with an interior cavity of the hollow body portion and each having an inlet adapted to be coupled to a different source of powder paint are each operative in a first state to enable fluid communication between a valve inlet and a valve outlet and operative in a second state to prevent fluid communication between the valve's inlet and outlet.

In another aspect of the invention, a powder paint color changer is of a two-piece construction wherein a replaceable or a nonreplaceable insert fashioned from a material resistant to impact fusion of powder paint particles with a surface of the insert is positioned within the color changer such as to define an interior cavity thereof. A plurality of valve elements are coupled to the color changer and are in fluid communication with the interior cavity formed by the replaceable insert.

BRIEF DESCRIPTION OF THE DRAWINGS

The objects and features of the invention will become apparent from a reading of a detailed description taken in conjunction with the drawing, in which.

DETAILED DESCRIPTION

Figure 1:
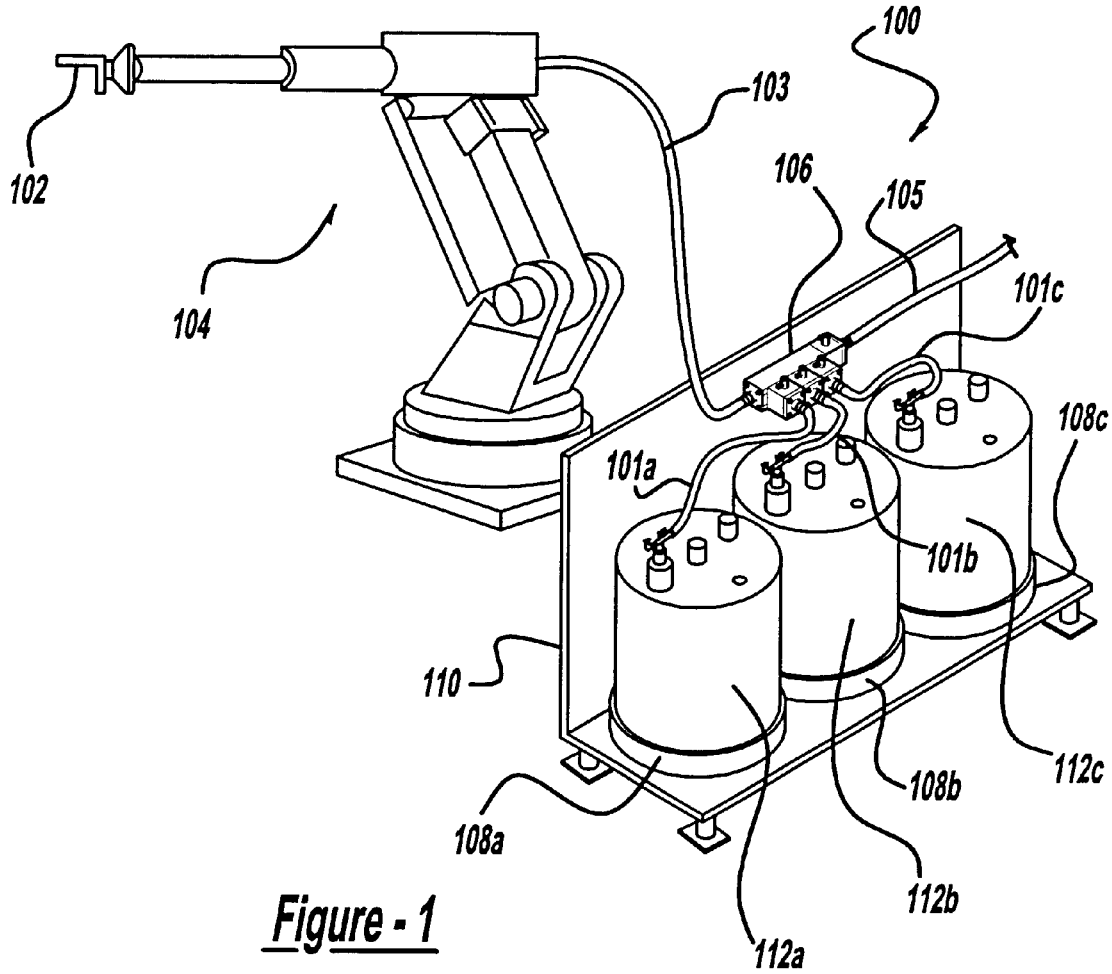
FIG. 1 is a perspective view of a powder paint application system arranged in accordance with the principles of the invention.

With reference to FIG. 1, a powder paint application system 100 includes a powder application gun 102 which is mounted to a robot assembly 104. However, it is to be understood that the color changer principles of this invention apply equally well to a manual system or a permanently mounted paint application gun.

The paint applicator 102 is supplied with air-borne powder paint through connecting hose 103 extending from a color changer 106 mounted to a portion of a support platform 110. Hose 105 couples a source of cleaning fluid, such as air, to color changer 106. Additionally, resting upon a substantially horizontal surface of support 110 are a plurality of powder feeding hoppers 112*a*, 112*b* and 112*c*. While three hoppers are shown, it will be apparent to those skilled in the art that any number of hoppers may be accommodated by a color paint changer arranged in accordance with the principles of this invention. In this description and the appended claims, "plurality" is used in the normal sense, meaning two or more.

Each powder feeding hopper 112 contains a different paint powder supply and an output of each hopper is coupled via a supply hose 101*a*, 101*b* and 101*c* to input ports of the color changing device 106 to be described in more detail below. The powder material in the feeding hoppers is fluidized by air through their porous bottom plates so that the powder material can be pneumatically conveyed by means of feeding injector pumps through color change valves to the paint application devices.

Each powder feeding hopper 112*a*, 112*b* and 112*c* rests upon a weighing scale 108*a*, 108*b* and 108*c*, respectively, in FIG. 1 which scale may be used to detect an empty or near-empty hopper, or can be used to effectively measure the flow rate of the powder paint product during a predetermined time period. Additionally, outputs of the scales 108 can be used in a closed-loop paint application control system in monitoring such things as paint flow rate and the amount of paint used in a particular application sequence.

With the arrangement shown in FIG. 1, the powder feeding hoppers 112 mounted to their respective weighing scales 108 on support 110 can be placed at any desired position with respect to the paint application apparatus 102, 104. Additionally, with the arrangement set forth in FIG. 1, it will be noted that paint supply hoses 101*a*, 101*b* and 101*c* at the hopper outputs may be minimized in length, as the paint supply hoppers 112 are located relatively close to the color changing apparatus 106.

Figure 2:
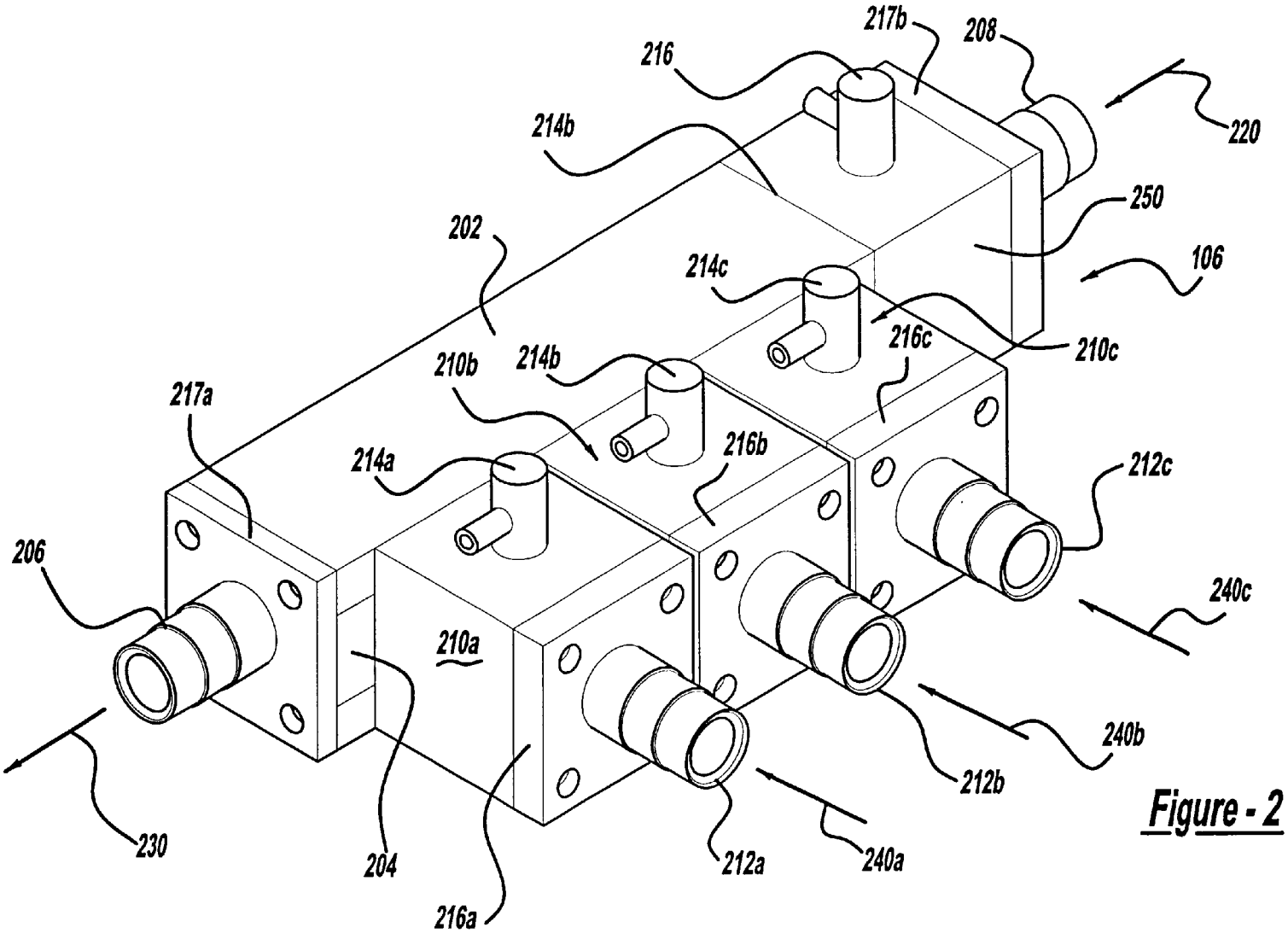
FIG. 2 is a perspective view of a powder paint color changer device arranged in accordance with the principles of the invention and adapted for use in the system of FIG. 1.
Figure 3:
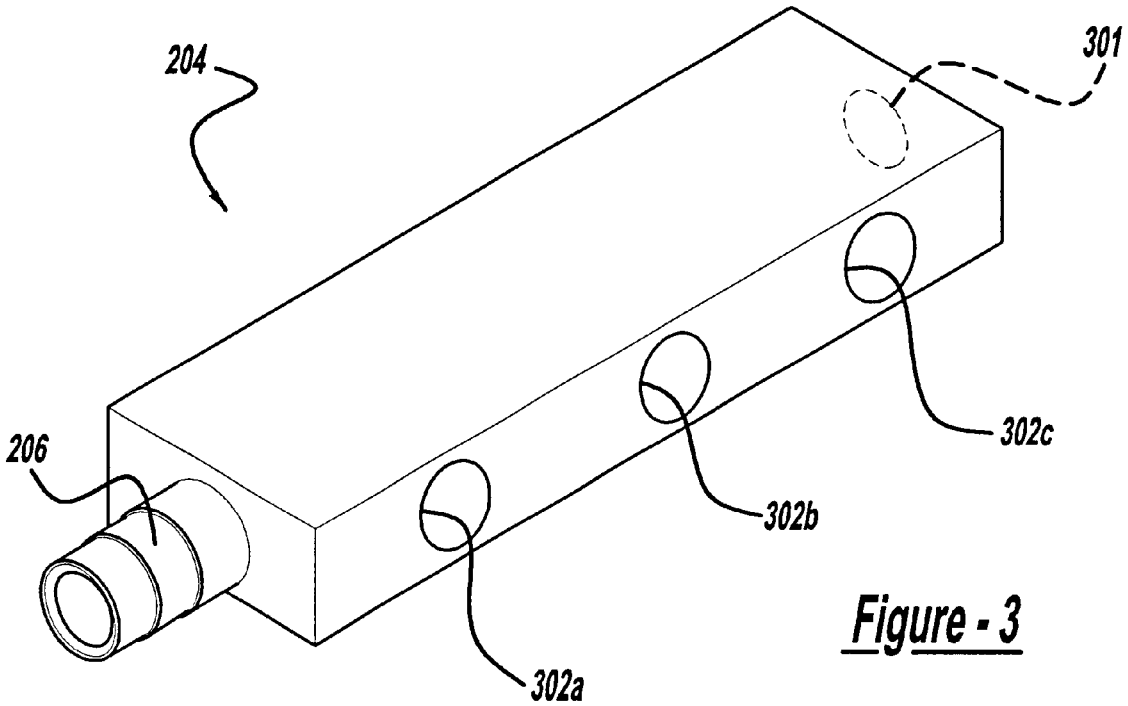
FIG. 3 is a perspective view of a replaceable insert portion of the color changer of FIG. 2.

With reference to FIGS. 2 and 3, the details of color changer 106 are set forth. Color changer element 106 utilizes a hollow body member or manifold 202 having an interior cavity (not specifically shown in FIG. 2) which is utilized to transfer powder paint from one of several color sources to a common outlet port 206 attached by a face plate 217*a* to the manifold 202.

An oppositely facing end 217*b* of manifold 202 provides an inlet port 208 adapted to be coupled to a source of cleaning fluid, such as pressurized air. Port 206 is conveniently formed as a hose barb, as shown, while port 208 utilizes a quick disconnect coupling to the cleaning fluid source.

Interposed between end cap 217*b* and the body proper 202 of the manifold is a valve 250 which, in this embodiment, comprises a pinch valve known to those skilled in the art. Such pinch valves are pneumatically operated via a compressed air port 216. As is known in the art, the interior of the pinch valve basically comprises a flexible cylinder, such as fashioned from a rubber product, surrounded by an activation chamber which, upon receipt of pressurized air, closes the flexible column thereby interrupting fluid communication between an input and an output of the pinch valve.

Mounted linearly along one side of manifold 202 are a plurality, in the case of FIG. 2 for example three, similar pinch valve assemblies 210*a*, 210*b* and 210*c*. Valves 210*a*, 210*b* and 210*c* are respectively equipped with pneumatic activation ports 214*a*, 214*b* and 214*c*. Pinch valves 210*a*, 210*b* and 210*c* are coupled to manifold 202 via suitable mounting bolts accessible from cover plates 216*a*, 216*b* and 216*c*, respectively.

At the inlet to each of the valve assemblies 210*a*, 210*b*, 210*c* are suitable hose barbs 212*a*, 212*b* and 212*c* respectively adapted for coupling to a supply line leading from a source of powder paint. For example, lines 101*a*, 101*b* and 101*c* of FIG. 1 respectively emanating from powder feeding hoppers 112*a*, 112*b* and 112*c* would be coupled to the hose barbs 212*a*, 212*b* and 212*c* shown in FIG. 2.

To minimize impact fusion along the surface of the interior cavity of manifold 202, manifold 202 is comprised of two different pieces. The first is of a suitable metal, such as steel or aluminum, which extends along appropriate surfaces of manifold 202 to enable strong coupling via, for example, bolts of the various pinch valve assemblies and end caps 214. Forming the inner surface of the interior cavity of manifold 202 is a low friction material 204, such as a plastic. Suitable plastics have been found to comprise polytetrafluorethylene (for example PTFE or Teflon) or other commercially available plastics such as polyoxymethylene (known as Acetal, Delrin and POM). The necessary property for the material of piece 204 of manifold 202 is that it is resistant to impact fusion between the surface of the material and the powder paint particles which may impinge thereon. Another way of stating the desired characteristic of the material of insert 204 is that it exhibits low surface friction.

For ease of replacement, the impact-fusion resistant material 204 is formed as a replaceable insert member of manifold 202. An exemplary insert 204 is set forth in the perspective view of FIG. 3. It will be noted from FIG. 3, that output port hose barb 206 is of the same material as insert 204 and, preferably, may be formed as an integral portion thereof. Additionally, as seen from FIG. 3, insert 204 is provided with inlet ports 302*a*, 302*b* and 302*c* along a lateral surface of insert 204 wherein ports 302 are respectively aligned with outputs of pinch valve assemblies 210*a*, 210*b* and 210*c* of FIG. 2. An end portion of the interior cavity which extends along a longitudinal axis of insert 204 (and therefore a longitudinal axis of manifold 202), is seen in phantom at 301 of FIG. 3. Port 301 in insert 204 is substantially aligned with and in fluid communication with an output of cleaner pinch valve 250 of FIG. 2.

It will be seen by those skilled in the art that insert 204 provides an impact fusion resistant surface for the main cavity of manifold 202 while simultaneously being fashioned in a form which makes insert 204 easily replaceable in the event that substantial use renders its surfaces unacceptable for further powder paint transmission to an application device.

An additional salient feature of the color changer 106 of FIG. 2 is the provision of a single manifold cavity cleaning fluid inlet port 208 substantially aligned with a longitudinal axis of the cavity at one end of manifold 202 and communicating with the cavity via a suitable valve such as pinch valve 250. This arrangement eliminates the need for providing separate air purge channels for each color inlet to the manifold.

Figure 4:
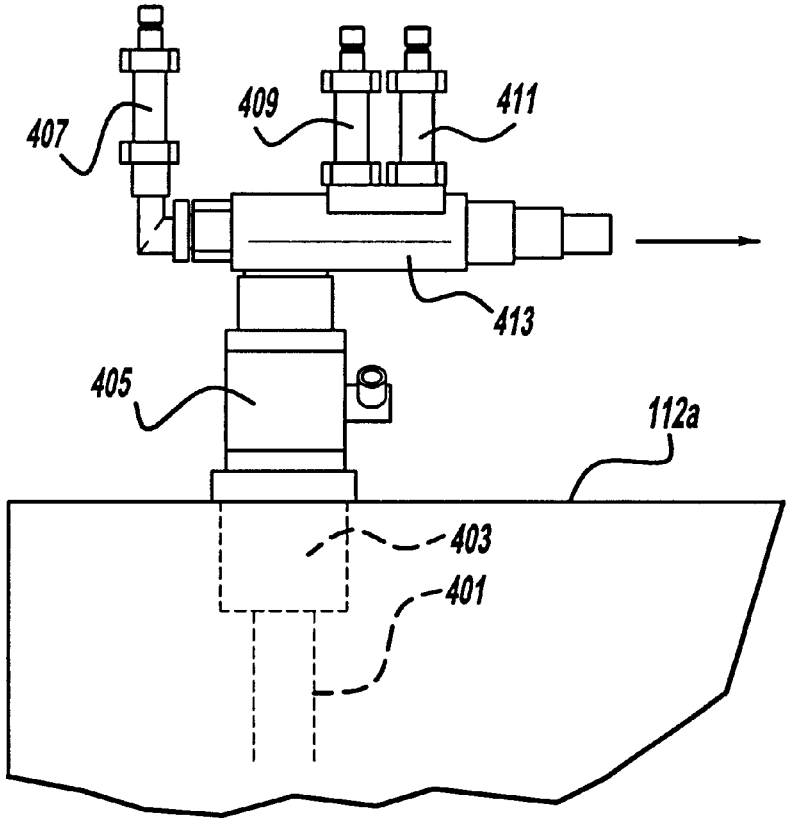
FIG. 4 sets forth more details of the output apparatus of the powder paint hopper used in the system of FIG. 1.

FIG. 4 sets forth pertinent details at the powder paint outlet of powder feeding hoppers 112 of FIG. 1. With reference to FIG. 4, for example, powder feeding hopper 112*a* has its powder paint output 401 coupled to supply hose 101*a* (FIG. 1) leading to color changer 106 via a quick disconnect coupling 403 and a pinch valve 405 which, in turn, is coupled to an outlet tube 413 supplied by main injector pump air source 407, along with supplemental air sources at inlets 409 and 411 which are conventionally used for dilution and mixing air sources as the powder paint particles are entrained in a suitable air flow for supplying color changer 106 of FIG. 2.

With the arrangement as set forth in the Figures, a prior disadvantage in powder paint color changing systems is overcome. In prior systems, the air connector on the existing injection pumps directing powder paint out of the powder feeding hoppers is relatively small and therefore would not ordinarily allow enough air flow and pulse strength to clean a supply line all the way from the feed injection pump to the paint applicator. This problem is solved in the instant application by placing the powder color changer 106 relatively close to the powder feeding hoppers 112 (FIG. 1) thereby enabling the relatively low volume air supply at inlet 407 to be capable of purging the powder hopper supply line between the hopper 112 and the color changer 106. The interior cavity of the manifold 202 itself, along with supply line 103 (FIG. 1) leading from the output of the color changing manifold 202 to the paint application device is purged and cleaned in a separate step via cleaning fluid supply coupled to manifold input 208.

To summarize, the overall system operation in terminating the powder paint application, cleaning the various supply lines and switching to a new color for the next application is, as follows.

When application of powder paint to a workpiece via gun 102 of application apparatus 104 (FIG. 1) is finished, powder paint transmission to gun 102 via color changer 106 is terminated by first stopping the conveying air and afterwards by closing pinch valve 405 (FIG. 4) at the outlet of the powder feeding hopper 112 (FIG. 1) in current use. During the preceding application interval, the hopper 112 in use supplies paint via its corresponding input pinch valve 210 of FIG. 2 to manifold 202, which, in turn, directs powder paint from manifold outlet 206 via supply hose 103 to applicator 102 of FIG. 1.

Upon closure of the hopper outlet pinch valve 405, purging air from the injector pump sources 407, 409 and 411 is directed, either in a continuous or in a pulsating manner, to the corresponding supply line 101 of FIG. 1 via outlet section 413 of FIG. 4 to purge the paint particles from the supply line 101 in use up to the interior cavity of manifold 202 of color changer 106 of FIG. 2. At the conclusion of this hopper supply line purging operation, the injector pump associated with the hopper in previous use is disabled, the corresponding inlet pinch valve 210 of FIG. 2 is closed, and cleaner pinch valve 250 of FIG. 2 is opened to establish fluid communication between a cleaning fluid source coupled to manifold inlet 208 and the interior cavity of manifold 202. Cleaning fluid, such as either continuous or pulsating pressurized air, is then directed through the interior cavity of insert 204 of color changer 106, thence via output 206 through supply line 103 of FIG. 1 and up through the dispensing mechanism 102 to provide cleaning of this portion of the paint delivery system.

At the conclusion of this purging step, a new workpiece is positioned with respect to dispensing element 102, a color is selected which, in turn, determines which powder feeding hopper 112 of FIG. 1 will be used in the subsequent application step, cleaning pinch valve 250 of FIG. 2 is closed, and pinch valve 405 of the appropriate hopper and pinch valve 210 of the corresponding inlet valve to the manifold 202 is opened in preparation for delivering powder paint via an injector pump at 407 through the color changing manifold 202 to application device 102 of FIG. 1.

As mentioned above, this whole process may be conducted in a closed-loop manner in a variety of ways utilizing information derived from the outputs of weighing scales 108*a*, 108*b* and 108*c* respectively associated with powder feeding hoppers 112*a*, 112*b* and 112*c* of FIG. 1. The closed loop control process involves comparing the actual powder flow rate (obtained through use of the weighing scales 108*a*, 108*b*, 108*c*) with the desired powder flow rate. Control calculations are performed via internal algorithms (within an automatic control device) and adjustments are made to the main injector pump air source 407 and supplemental air sources 409, 411. These adjustments correct for any variance in powder flow rate that may occur over the spraying period, due to any disturbances in the process.

A powder paint dispensing and color changing system arranged in accordance with the principles of this invention will therefore be seen to provide modularity, ease of fabrication and facile maintenance and inspection of parts for such problems as impact fusion on surfaces thereof.

The invention has been described in conjunction with the detailed description of a preferred embodiment for the sake of example only. The scope and spirit of the invention are as set forth in the appended claims.

What is claimed is:

1. A powder paint color changer comprising:

a hollow body portion having first and second opposed ports at its outer surface, the first port adapted to be coupled to a source of cleaning fluid and the second port adapted to be coupled to a powder paint application device; and a plurality of valves, each having an outlet in fluid communication with an interior cavity of the hollow body portion, the interior cavity being defined by a removable insert fashioned from a material resistant to impact fusion therewith of powder paint particles and each valve having state to enable fluid communication between its inlet and outlet and operative in a second firs adapted to be coupled to a different source of powder paint, each valve operative in a state to prevent fluid communication between its inlet and outlet.

2. The color changer of claim 1 further comprising a cleaner valve coupled between the first port and the interior cavity, the cleaner valve operative in a first state to pass cleaning fluid therein to the interior cavity and operative in a second state to prevent cleaning fluid from reaching the interior cavity.

3. The color changer of claim 1 wherein the material comprises a plastic.

4. The color changer of claim 3 wherein the plastic comprises polytetrafluorethylene.

5. The color changer of claim 1 wherein the second port of the hollow body portion comprises a hose barb extending from the removable insert and formed of the material.

6. The color changer of claim 5 wherein the hose barb comprises an integral portion of the removable insert.

7. A powder paint color changer comprising:

an elongate manifold having an interior cavity extending along a longitudinal axis of the manifold, the manifold further including first and second end portions facing each other at opposite ends of the longitudinal axis, and a side surface extending between the first and second end portions, wherein all exposed surfaces of the interior cavity are provided on a removable insert fashioned from a material resistant to impact fusion therewith of powder paint particles;

an outlet port in the first end portion adapted to be coupled via a hose to a powder paint application device;

an inlet port in the second end portion adapted to be coupled to a source of cleaning fluid; and a plurality of valves coupled to the side surface, each valve having an inlet adapted to be coupled to a different source of powder paint and an outlet in fluid communication with the interior cavity, each valve operative in a first state to enable fluid communication between its inlet and outlet and operative in a second state to prevent fluid communication between its inlet and outlet.

8. The color changer of claim 7 further comprising a cleaner valve having an outlet in fluid communication with the inlet port and an inlet adapted to be coupled to a source of cleaning fluid, the cleaner valve operative in a first state to enable fluid communication between its inlet and outlet and operative in a second state to prevent fluid communication between its input and output.

9. The color changer of claim 7 wherein the plurality of valves comprises pneumatically operated pinch valves.

10. The color changer of claim 8 wherein the cleaner valve comprises a pneumatically operated pinch valve.

11. A powder paint color changer comprising:

a rectanguloid manifold having an interior cavity extending along a longitudinal axis of the manifold, the interior cavity being defined by a replaceable insert fashioned from an impact fusion resistant material housed within the manifold, the manifold further including first and second end portions facing each other at opposite ends of the longitudinal axis;

the replaceable insert including a hose barb extending through the first end portion and adapted for receipt of a hose coupled to a powder paint application device;

a cleaning port in the second end portion adapted to be coupled to a source of cleaning fluid via a pneumatically operated cleaning pinch valve; and a plurality of pneumatically operated powder paint supply pinch valves mounted successively along one side of the rectanguloid manifold between the first and second end portions, each powder paint supply valve having an inlet adapted to be coupled to a different source of powder paint and an outlet in fluid communication with the interior cavity via ports formed in the replaceable insert.

12. The color changer of claim 11 wherein the material of the replaceable insert comprises plastic.

13. The color changer of claim 12 wherein the plastic comprises polytetrafluorethylene.

14. A powder paint color changer comprising:

a two-piece manifold assembly, with one piece thereof being formed from metal to define manifold outer surfaces capable of withstanding mounting forces of apparatus coupled thereto, and a second piece formed of an impact fusion resistant material defining interior surfaces of the manifold adapted to be in contact with powder paint particles introduced into the manifold.

15. The powder paint color changer of claim 14 wherein the second piece is removably coupled to the second piece.

16. A powder paint application system comprising:

a plurality of powder paint supply hoppers, each containing powder paint of a different preselected color, and each hopper having a paint output assembly;

a powder paint color changer having a plurality of input valves, each coupled for receipt of powder paint from an associated paint output assembly of one of the plurality of hoppers, the powder paint color changer further including a manifold with an interior cavity in fluid communication with each of the input valves, the interior cavity being formed from a removable insert fashioned from a material resistant to impact fusion with paint particles impinging thereon and having an outlet port and a cleaning valve in fluid communication with the interior cavity and coupled for receipt of a cleaning fluid at an input port positioned opposite the outlet port;

each output assembly including a valve capable of interrupting hopper powder paint flow to an associated color changer input valve and an injection pump for enabling flow of powder paint entrained in a transport mechanism; and wherein each powder paint supply hopper rests on an associated weighing scale having an output indicative of the weight of the powder material resident in the associated hopper.

* * * * *

UNITED STATES PATENT AND TRADEMARK OFFICE

CERTIFICATE OF CORRECTION

PATENT NO. : 6,589,342 B2
DATED : July 8, 2003
INVENTOR(S) : Richard A. Attinoto et al.

It is certified that error appears in the above-identified patent and that said Letters Patent is hereby corrected as shown below:

Column 6,
Lines 4-8, "state to enable fluid communication between its inlet and outlet and operative in a second firs adapted to be coupled to a different source of powder paint, each valve operative in a state to prevent fluid communication between its inlet and outlet" should be
-- an inlet adapted to be coupled to a different source of powder paint, each valve operative in a first state to enable fluid communication between its inlet and outlet and operative and operative in a second state to prevent fluid communication between its inlet and outlet --.

Signed and Sealed this

Fourth Day of November, 2003

JAMES E. ROGAN
*Director of the United States Patent and Trademark Office*